US007107632B2

(12) United States Patent
Huff et al.

(10) Patent No.: US 7,107,632 B2
(45) Date of Patent: Sep. 19, 2006

(54) TOILET RAMP

(76) Inventors: Donald Keith Huff, 203 Lando Dr., Spotsylvania, VA (US) 22553; Karen Kay Lawhorn Huff, 203 Lando Dr., Spotsylvania, VA (US) 22553

( * ) Notice: Subject to any disclaimer, the term of this patent is extended or adjusted under 35 U.S.C. 154(b) by 227 days.

(21) Appl. No.: 10/770,206

(22) Filed: Feb. 3, 2004

(65) Prior Publication Data

US 2005/0166314 A1 Aug. 4, 2005

(51) Int. Cl.
*A47K 17/00* (2006.01)

(52) U.S. Cl. ..... 4/661; 254/2 C; 280/47.34

(58) Field of Classification Search ..... 4/661; 220/573, 574; 280/47.34; 254/2 C, 2 R, 254/4 C, 7 R
See application file for complete search history.

(56) References Cited

U.S. PATENT DOCUMENTS 4,722,511 A * 2/1988 Chitwood ..... 254/7 R
4,751,753 A * 6/1988 Sargent et al. ..... 4/321
5,184,653 A * 2/1993 Lacy ..... 141/98
5,505,430 A * 4/1996 Barnett ..... 254/2 R

FOREIGN PATENT DOCUMENTS

JP 10-43091 * 2/1998

* cited by examiner

*Primary Examiner*—Huyen Le

(57) ABSTRACT

A toilet ramp serving as a movable device for supporting and transporting a toilet bowl once it is lifted off from a floor comprises a body of a rectangular shape having a opening at each of the two opposite sides for inspecting and removing a wax seal underneath the toilet bowl, a circular opening at the top of the ramp for providing access to the wax seal from the openings of the sides, and an adjustable handle on the front side of the ramp.

4 Claims, 2 Drawing Sheets

A side view of The Toilet Ramp

FIG: 1
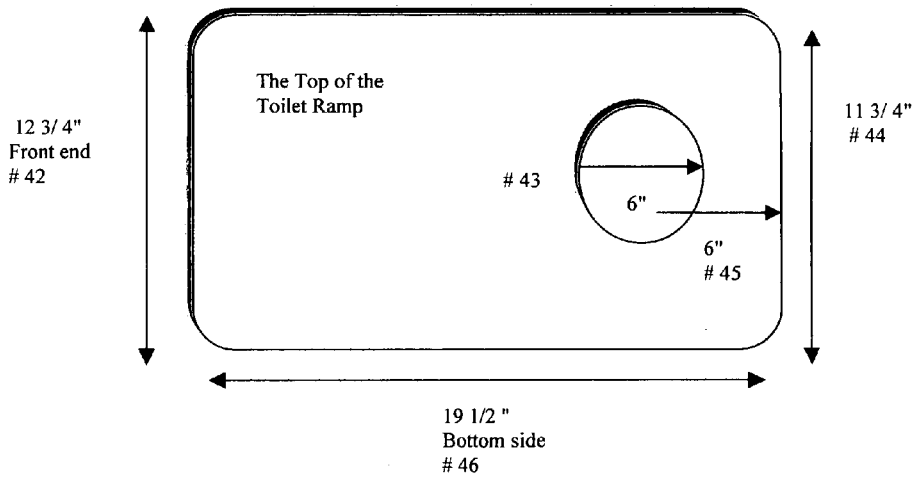
A side view of The Toilet Ramp FIG: 2
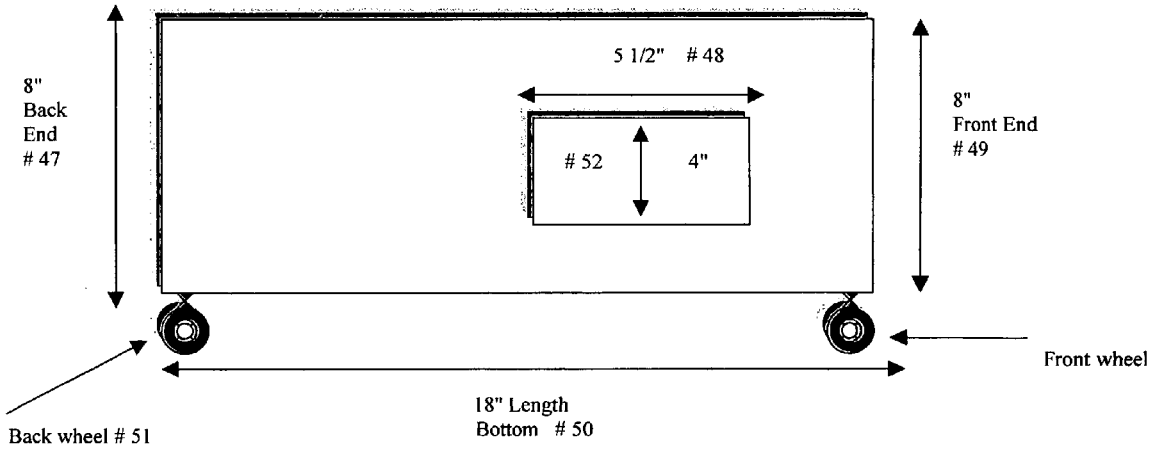

TOILET RAMP

CROSS REFERENCE TO OTHER APPLICATION

Repeat use of reference characters in the present specification and drawings is intended to represent same or analogous features or elements of the invention. But not limited to.

This invention relates generally to plumbing as a plumbing tool for placing a said toilet bowl on to. To do the repairs as needed.

Is designed to solve the problem of where to temporarily place a toilet during plumbing or other repairs. It also accommodates a space where you can remove a bacterium wax and prevents water spills.

Method and apparatus for filling a wood, plastic or fiberglass square shape structure that supports the edge of toilet bowls or bases off the floor.

BACKGROUND OF THE INVENTION

This invention relates to a method which will allow you to do repairs on said bowls and floor repairs in a matter of placing the said bowl off the floor and out of your way while repairing the plumbing problem. This particular ramp will allow you to clean the bacterial wax seal without tilting the said bowl.

Several modifications and design considerations for the toilet ramp might prove to be of interest to the developer. For instance, consideration might be given to a version that is made of plastic Or fiberglass and wood.

The design parameters for this product are amenable to current production processes and tooling, and the materials specified are commonly available on the commercial level. Due to the toilet ramp very simple components, it should be no problem to produce from any technical standpoint, and existing assembly lines could be easily adapted for its speedy manufacture, well as explore possible variations and modifications to further improve the design of the product.

SUMMARY OF THE INVENTION

The basic purpose of the invention is to provide a method and apparatus by means of which a structured item that will support the said bowl. This will allow you to clean underneath the bowl without tilting the said bowl. With the four wheels attached to the structure it also allows easy removal of the bowl out of the bathroom if you need to replace the bowl.

With the handle that can be adjustable makes the ramp easy to pull or push any where you desire. This handle can be pulled out to 6" inches or can be pulled up to 24" inches.

BRIEF DESCRIPTION OF THE DRAWINGS

FIG. 1 is a simplified view of the top of the toilet ramp that allows you to view the 6" hole that you place the toilet on for support.

FIG. 2 is a simplified side view of the toilet ramp which allows you to view the 5/12 by 4" hole that you place your hand through to clean the wax seal off of the toilet.

DESCRIPTION OF THE PREFERRED EMBODIMENT

Figure 3:
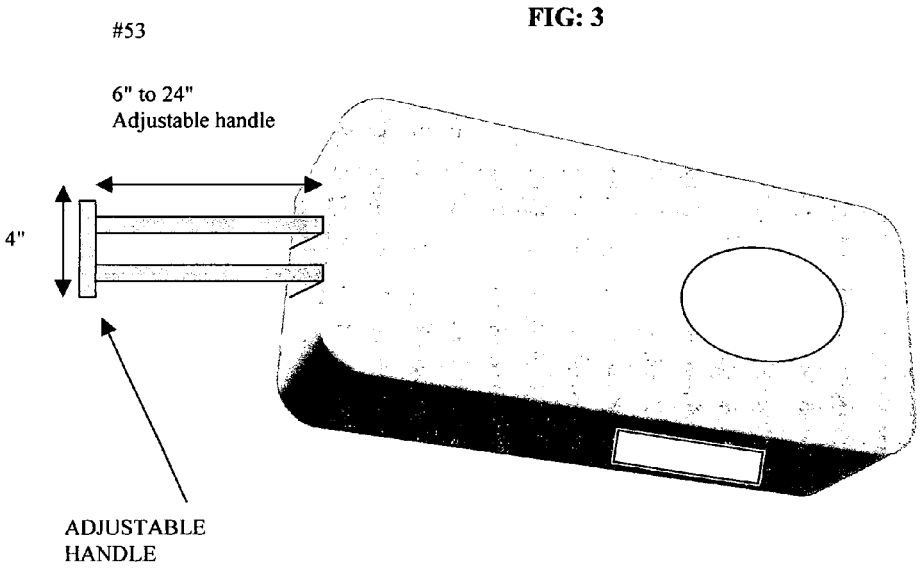
FIG. 3 is a view of the adjustable handle that will easily slide back in groves and can adjust to 6" up to 24" inches.

Referring now in more detail to the preferred inventive embodiment illustrated in the drawings, each feature whose functions will be explained presently. The toilet ramp is relatively flat on the top and bottom. The ramp can be improved to different sizes, colors, with or without wheels, collapsible plastic, and fiberglass and can be made up of wood. This particular item can also have a 2 gallon water storage container equipped with the toilet ramp for the remaining water left in the said bowl before removing the said bowl. The toilet ramp is designed to help the consumer to have a place to put the toilet while doing repairs. Until now all consumers that has ever removed a toilet had no where to put the toilet except on the floor tilted or in the bathtub. Now there is something out there for that purpose called the toilet ramp and you can easily clean the bottom of the toilet without tilting it also.

The toilet ramp will be lightweight for easy carrying and compact for the consumer. This item will be able to hold up to 100 lbs in weight. The ramp is designed and built with the convenience in mind of having somewhere to set the toilet while changing the wax seal, replacing toilet or just doing the floor repairs. The maintenance of the toilet ramp would only be cleaning the wax and water off of the ramp after replacing the said bowl.

FIG. 1 this shows the top to the toilet ramp 19½ inches long as illustrated on page 1 of 2. The back of the toilet ramp will be 11¾ inches wide and the front will be 12¾ inches wide. This will support the said bowl weight evenly on the ramp. Place the toilet in the 6" inch circular opening as illustrated in FIG. 1 # 43 on page 1 of 2. This 6" inch opening purpose will be to hold the said bowl in an evenly matter.

FIG. 2 this shows a side view of the toilet ramp that will be 8" inches off the floor as illustrated on page 1 of 2. There will be a rectangular opening of 5½" by 4" inches FIG. 2 # 48 and # 52 for easy access of cleaning of the old wax seal off the bottom of the bowl 49 before replacing back to the floor.

FIG. 3 this shows the top of the toilet ramp with the adjustable handle on the front side of the ramp this handle will slide back in space when finished using the handle. The handle can be adjustable up to 24 inches. This handle can be used for removing the said bowl out of the bathroom for repairs. The handle will adjust from 6" inches to 24" as illustrated on page 2 of 2 # 53.

Figure 4:
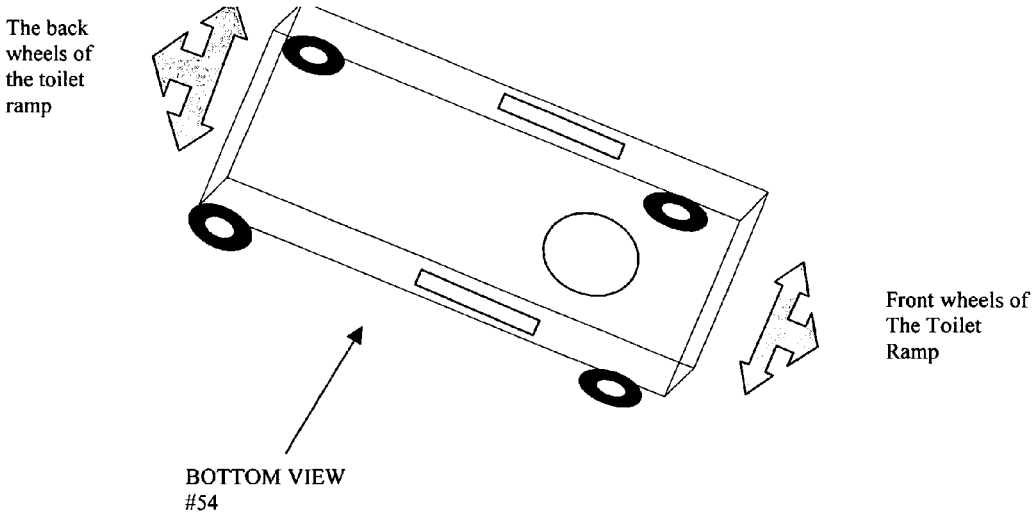
FIG. 4 are a simplified view of the 4 wheels at the bottom of the ramp.

FIG. 4 this shows the 4 wheels located at the bottom of the toilet ramp which will allow you to wheel the said bowl out of the bathroom. The wheels will be able to turn in a 360-degree angle. The wheels can be removed. This will allow the wheels to be snapped on or off at any time.

What is claim is:

1. A toilet ramp for supporting a toilet bowl once the toilet bowl is lifted off from a floor comprising: a body of a rectangle shape having a top, a bottom, a front, a back and two opposite sides for supporting the weight of the toilet bowl when the toilet bowl is located on the top of the body; an opening located at each of the two opposite sides for inspecting, removing and installing a wax seal underneath the toilet bowl; a circular opening at the top of the body for providing access to the wax seal from the openings of the sides; and snap on/off wheels for providing the convenience of removing the toilet bowl out of the toilet area.

2. The ramp according to claim 1, wherein the circular opening is about 6 inches in diameter.

3. The ramp according to claim 1, wherein the opening of each of the two opposite sides has a dimension of about 5 by 6 inches.

4. The ramp according to claim 1, wherein the front of the ramp is about 12 ¾inches and the back of the ramp is about 11¾inches.

* * * * *